US008666097B2

(12) United States Patent
Ichikawa et al.

(10) Patent No.: US 8,666,097 B2
(45) Date of Patent: Mar. 4, 2014

(54) ELECTROSTATIC SPEAKER

(75) Inventors: Hiromi Ichikawa, Hamamatsu (JP); Yoshikatsu Matsubara, Hamamatsu (JP)

(73) Assignee: Yamaha Corporation, Hamamatsu-Shi, Shizuoka-ken (JP)

( * ) Notice: Subject to any disclaimer, the term of this patent is extended or adjusted under 35 U.S.C. 154(b) by 318 days.

(21) Appl. No.: 12/891,692

(22) Filed: Sep. 27, 2010

(65) Prior Publication Data

US 2011/0075869 A1 Mar. 31, 2011

(30) Foreign Application Priority Data

Sep. 30, 2009 (JP) ..... 2009-226383

(51) Int. Cl.
*H04R 25/00* (2006.01)

(52) U.S. Cl.
USPC ..... 381/191; 381/150; 381/174

(58) Field of Classification Search
USPC ..... 381/191, 173–176, 429, 431; 310/311, 310/322, 325
See application file for complete search history.

(56) References Cited

U.S. PATENT DOCUMENTS

| | | | | |
|---|---|---|---|---|
| 3,935,397 | A | 1/1976 | West | |
| 5,392,358 | A | 2/1995 | Driver | |
| 5,889,873 | A * | 3/1999 | Sasaki | 381/190 |
| 6,434,245 | B1 | 8/2002 | Zimmermann | |
| 6,825,593 | B2 * | 11/2004 | Takeshima | 310/330 |
| 7,184,563 | B2 | 2/2007 | Collins | |
| 8,000,483 | B2 * | 8/2011 | de Haan et al. | 381/190 |
| 8,243,966 | B2 * | 8/2012 | Lin et al. | 381/191 |
| 2009/0016552 | A1 * | 1/2009 | Medley et al. | 381/191 |
| 2009/0034761 | A1 * | 2/2009 | Nakaya et al. | 381/191 |

FOREIGN PATENT DOCUMENTS

| | | | |
|---|---|---|---|
| CN | 1757261 | A | 4/2006 |
| EP | 1 860 913 | A2 | 11/2007 |
| JP | 2007-318554 | A | 12/2007 |
| JP | 2008-227832 | A | 9/2008 |

OTHER PUBLICATIONS

Chinese Office Action issued for corresponding application CN 201010502360.3, mailing date Jan. 23, 2013. (with attached English translation).
European Search Report issued for corresponding application EP 10 01 0909, mailing date Dec. 3, 2013.

* cited by examiner

*Primary Examiner* — Brian Ensey
*Assistant Examiner* — Sabrina Diaz
(74) *Attorney, Agent, or Firm* — Dickstein Shapiro LLP

(57) ABSTRACT

An electrostatic speaker is constituted of upper/lower electrodes, upper/lower cushion materials, and a diaphragm. Cutouts are formed in the upper/lower electrodes, upper/lower cushion materials, and diaphragm, wherein they are shifted in position such that a part of the diaphragm and a part of the lower electrode are exposed and seen through those cutouts to horizontally adjoin in the cutout of the upper electrode. The electrostatic speaker is driven via a clip having electrodes in response to audio signals, wherein drive voltages are applied to each of the upper/lower electrodes and the diaphragm.

19 Claims, 10 Drawing Sheets

ELECTROSTATIC SPEAKER

BACKGROUND OF THE INVENTION

1. Field of the Invention

The present invention relates to electrostatic speakers (or capacitor speakers) constituted of parallel planar electrodes and diaphragms.

The present application claims priority on Japanese Patent Application No. 2009-226383, the content of which is incorporated herein by reference.

2. Description of the Related Art

Patent Document 1 (i.e. Japanese Patent Application Publication No, 2007-318554) discloses an electrostatic speaker in which a film-shaped diaphragm having conductivity is interposed between two planar electrodes which are disposed in parallel with a gap therebetween. A bias voltage is applied to a diaphragm while a voltage is applied to electrodes, thus causing an electrostatic force on the diaphragm. When an applied voltage of electrodes varies, an electrostatic force of a diaphragm varies so as to cause a displacement in the diaphragm. When an applied voltage of electrodes varies in response to an audio signal, displacements repeatedly occur on a diaphragm to vibrate, thus producing sound waves in response to an audio signal. That is, an electrostatic speaker emits sound waves to the external space via electrodes.

Patent Document 1 adopts a power-supply method in which an electric power is supplied to a diaphragm via a conducting wire soldered to the diaphragm. It discloses another power-supply method in which a crimp terminal (or a solder-less terminal) connected with a conducting wire is fixed with screws to a pair of metal plates sandwiching a diaphragm.

Diaphragms are produced by depositing metals on synthetic-resin films, the thickness of which ranges from several micrometers to several tens of micrometers. For this reason, diaphragms having a small thickness are easily affected by heat, which occurs during soldering of conductive wires; hence, a high technique for soldering conductive wires onto diaphragms is needed. The power-supply method, in which a conducting wire is fixed to a diaphragm with a screw, does not cause heat to affect the diaphragm; however, this requires a time-consuming job for attaching and detaching conducting wires with diaphragms by use of drivers.

SUMMARY OF THE INVENTION

It is an object of the present invention to provide an electrostatic speaker which is able to supply power and signals to a diaphragm and electrodes with ease.

An electrostatic speaker of the present invention is constituted of a first electrode, a second electrode disposed opposite to and distanced from the first electrode, a diaphragm interposed between the first electrode and the second electrode and distanced from the first electrode and the second electrode, a first elastic member interposed between the first electrode and the diaphragm, and a second elastic member interposed between the diaphragm and the second electrode. The first and second elastic members have elasticity and sound permeability as well as insulating properties. Windows (e.g. cutouts or holes) are formed in each of the first electrode, the first and second elastic members, and the diaphragm. The window of the first electrode overlaps the window of the first elastic member in plan view so that a part of the diaphragm is exposed and seen through the window of the first electrode. The windows of the first electrode and the first elastic member partially overlap the windows of the diaphragm and the second elastic member in plan view so that a part of the second electrode is exposed and seen through the window of the first electrode.

In the above, the exposed part of the diaphragm and the exposed part of the second electrode horizontally adjoin. Alternatively, the exposed part of the diaphragm and the exposed part of the second electrode horizontally adjoin along an edge line of the electrostatic speaker.

In another aspect of the present invention, windows are formed in the first electrode, the diaphragm, and the second electrode respectively. A part of the diaphragm is disposed in a region in which the window of the first electrode overlaps the window of the second electrode in plan view. A part of the first electrode is disposed in a region in which the window of the diaphragm overlaps the window of the second electrode. A part of the second electrode is disposed in a region in which the window of the first electrode overlaps the window of the diaphragm.

In the above, the first electrode is constituted of a first base material and a first conductive layer which are laminated together; the second electrode is constituted of a second base material and a second conductive layer which are laminated together; and the diaphragm is constituted of a third base material and a third conductive layer which are laminated together. The windows of the first electrode, the second electrode, and the diaphragm are formed in the first conductive layer, the second conductive layer, and the third conductive layer, respectively.

BRIEF DESCRIPTION OF THE DRAWINGS

These and other objects, aspects, and embodiments of the present invention will be described in more detail with reference to the following drawings.

DESCRIPTION OF THE PREFERRED EMBODIMENT

The present invention will be described in further detail by way of examples with reference to the accompanying drawings.

Figure 1:
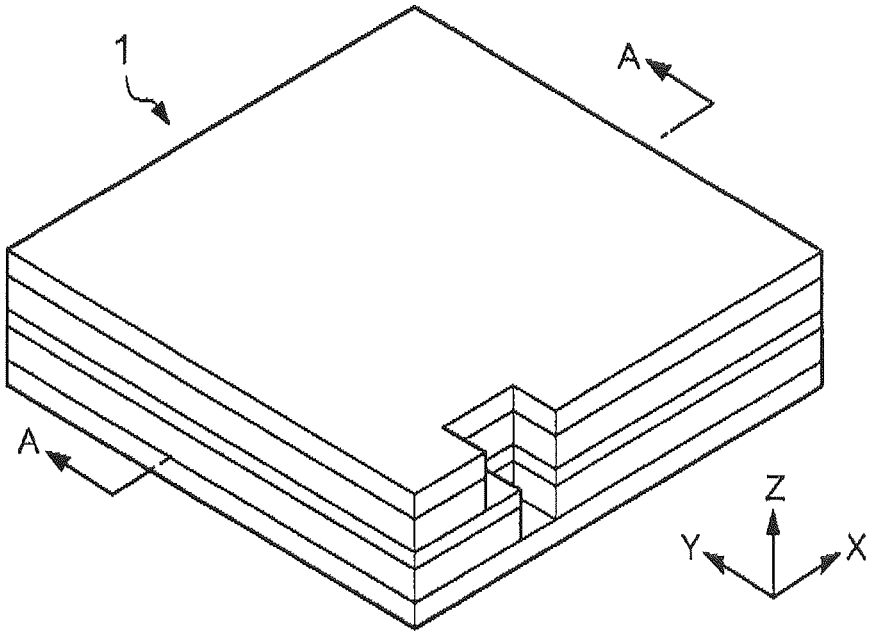
FIG. 1 is a perspective view showing an exterior appearance of an electrostatic speaker according to an embodiment of the present invention.
Figure 2:
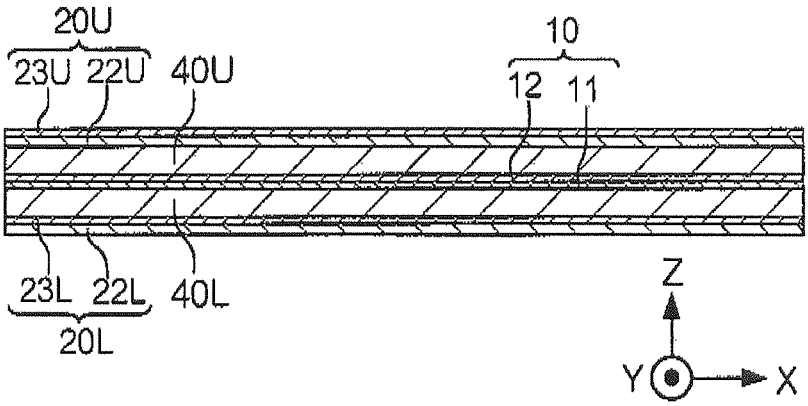
FIG. 2 is a cross-sectional view taken along line A-A in FIG. 1.
Figure 3:
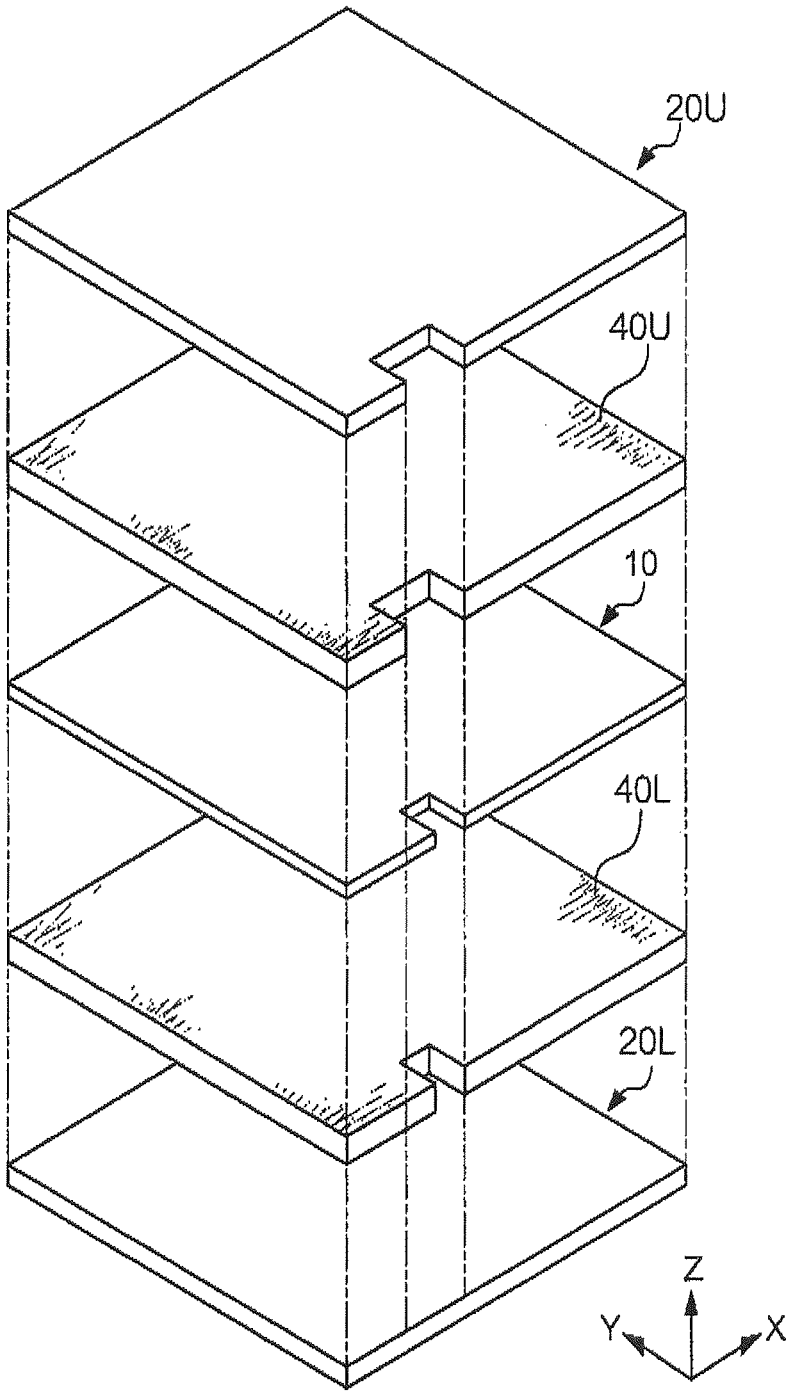
FIG. 3 is an exploded perspective view of the electrostatic speaker.

FIG. 1 is a perspective view showing an exterior appearance of an electrostatic speaker 1 according to an embodiment of the present invention. FIG. 2 is a cross-sectional view taken along line A-A in FIG. 1, showing an interior structure of the electrostatic speaker 1. FIG. 3 is an exploded perspective view of the electrostatic speaker 1. The drawings employ a three-dimensional coordinate system consisting of an X-axis, a Y-axis, and a Z-axis which are perpendicular to each other. The X-axis direction is a right-left direction (or a width direction) of the electrostatic speaker 1 viewed in its front side; the Y-axis direction is a length direction (or a depth direction) of the electrostatic speaker 1; and the Z-axis direction is a height direction (or a vertical direction) of the electrostatic speaker 1. The drawings are not necessarily illustrated with precise measurements; hence, dimensions of illustrations are modified for readers to easily grasp shapes of constituent elements.

The electrostatic speaker 1 is constituted of a diaphragm 10, electrodes 20U and 20L, and cushion materials 40U and 40L, wherein symbols "U" and "L" represent "upper" and "lower" respectively; hence, these symbols are omitted as being unnecessary.

Next, the constituent elements of the electrostatic speaker 1 will be described in detail. The diaphragm 10 includes a film (or a base material) 11 composed of PET (i.e. polyethylene terephthalate) or PP (i.e. polypropylene) and a conductive layer 12. A conductive metal is deposited on one surface of the film 11 or a conductive coating is applied to one surface of the film 11, thus forming the conductive layer 12 on the film 11. The thickness of the diaphragm 10 ranges from several micrometers to several tens of micrometers. The diaphragm 1 has a rectangular shape in plan view, wherein a part of one side in the width direction (or the X-axis direction) is recessed to form a cutout having a predetermined width, which is cut into the diaphragm 1 in the length direction (or the Y-axis direction).

The diaphragm 10 of the present embodiment is designed such that one surface of the film 11 is deposited with a conductive metal or applied with a conductive coating. Of course, it is possible to deposit conductive metals on or apply conductive coating to both surfaces of the film 11. The material of the film 11 of the diaphragm 1 is not necessarily limited to PET and PP; hence, it is possible to deposit a conductive metal on or apply a conductive coating to a film composed of another synthetic resin.

The electrode 20U includes a film (or a base material) 22U composed of PET and a conductive layer 23U. A conductive metal (e.g. aluminum) is deposited on or a conductive coating is applied to one surface of the film 22U, thus forming the conductive layer 23U. A plurality of through-holes is formed to run through the electrode 20U from its surface to the backside. The drawings do not illustrate through-holes for the sake of simplicity. The electrode 20U has a rectangular shape in plan view, wherein a part of one side in the width direction is recessed to form a cutout having a predetermined width, which is cut into the electrode 20U in the length direction. In this connection, the width of the cutout of the electrode 20U is longer than the width of the cutout of the diaphragm 10, while the length of the cutout of the electrode 20U is identical to the length of the cutout of the diaphragm 10. The electrode 20U has bendability because it is constituted of a PET sheet having flexibility.

The electrode 20L includes a film (or a base material) 22L composed of PET and a conductive layer 23L. A conductive metal is deposited on or a conductive coating is applied to one surface of the film 22L, thus forming the conductive layer 23L. A plurality of through-holes (not shown) is formed to run through the electrode 20L from its surface to the backside. Unlike the electrode 20U, the electrode 20L has no cutout.

In the present embodiment, the electrodes 20U and 20L are each designed such that a conductive metal is deposited on or a conductive coating is applied to one surface of a base material; but this is not a restriction. It is possible to deposit conductive metals on or apply a conductive coating to both surfaces of a base material. The material used for the films 22U and 22L of the electrodes 20U and 20L is not limited to PET; hence, it is possible to use other synthetic resins, so that conductive metals are deposited on or a conductive coating is applied to films composed of other synthetic resins.

The cushion materials 40U and 40L are each composed with cottons which are compressed under heating, so that they have permeability of air and sound therethrough. The cushion materials 40U and 40L having electrical insulating property and elasticity can be deformed due to an external force but easily restored in shape when an external force is removed.

The cushion material 40U has a rectangular shape in plan view, wherein a part of one side in the width direction is recessed to form a cutout which is cut into the cushion material 40U in the length direction. Similarly, the cushion material 40L has a rectangular shape in plan view, wherein a part of one side in the width direction is recessed to form a cutout which is cut into the cushion material 40L in the length direction.

The position of the cutout of the cushion material 40U precisely matches the position of the cutout of the electrode 20U. The width and length of the cutout of the cushion material 40U are equal to the width and length of the cutout of the electrode 20U.

The position of the cutout of the cushion material 40L precisely matches the position of the cutout of the diaphragm 10. The width and length of the cutout of the cushion material 40L are equal to the width and length of the cutout of the diaphragm 10.

Next, the structure of the electrostatic speaker 1 will be described in detail. The diaphragm 10 is interposed between the cushion materials 40U and 40L such that the conductive layer 12 of the diaphragm 10 is attached to the lower surface of the cushion material 40U while the lower surface of the diaphragm 10 is attached to the upper surface of the cushion material 40L. The diaphragm 10 is bonded onto the cushion materials 40U and 40L via bonds applied to left/right edges (along the width direction) and front/rear edges (along the length direction) of the diaphragm 10 with bond margins of several millimeters measured inwardly from the corresponding edge. That is, the internal area of the diaphragm 10 inwardly of bond margins is not fixed to the cushion materials 40U and 40L.

In addition, the conductive layer 23L of the electrode 20L is directed toward the diaphragm 10 and attached to the lower surface of the cushion material 40L, while the film 22U of the electrode 20U is directed toward the diaphragm 10 and attached to the upper surface of the cushion material 40U. In this connection, the electrode 20U and the cushion material 40U are bonded together via bonds applied to left/right edges (along the width direction) and front/rear edges (along the length direction) of the electrode 20U with bond margins of several millimeters measured inwardly from the corresponding edge, so that the internal area of the electrode 20U inwardly of bond margins is not fixed to the cushion material 40U. In addition, the electrode 20L and the cushion material 40L are bonded together via bonds applied to left/right edges (along the width direction) and front/rear edges (along the length direction) of the electrode 20L with bond margins of several millimeters, so that the internal area of the electrode 20L inwardly of bond margins is not fixed to the cushion material 40L.

Figure 4:
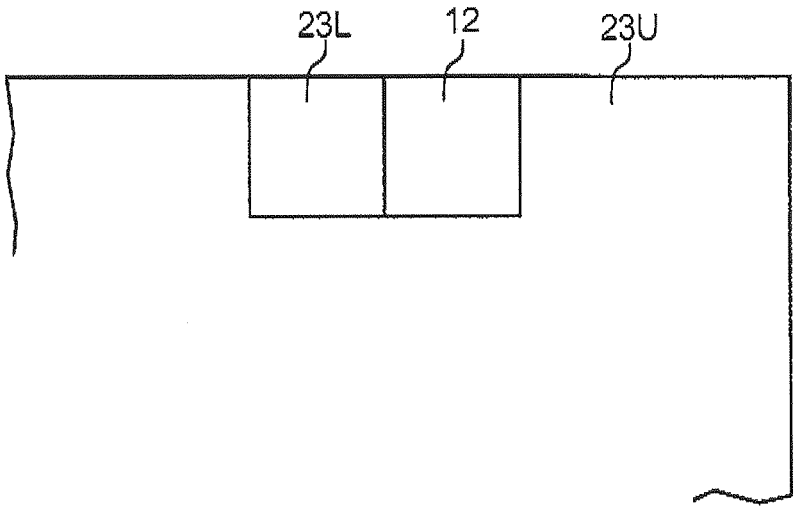
FIG. 4 is a plan view of the electrostatic speaker seeing through cutouts of constituent elements.

FIG. 4 is a plan view of the electrostatic speaker 1 seeing through cutouts. Both the width of the cutout of the diaphragm 10 and the width of the cutout of the cushion material 40L are smaller than the width of the cutout of the electrode 20U and the width of the cutout of the cushion material 40U; hence, the cutout of the diaphragm 10 and the cutout of the cushion material 40L fall within the cutout of the electrode 20U and the cutout of the cushion material 40U in plan view. That is, a part of the conductive layer 1 of the diaphragm 10 is exposed through the cutout of the cushion material 40U and the cutout of the electrode 20U, while a part of the conductive layer 23L of the electrode 20L is exposed through the cutout of the cushion material 40L, the cutout of the diaphragm 10, the cutout of the cushion material 40U, and the cutout of the electrode 20U.

Figure 5:
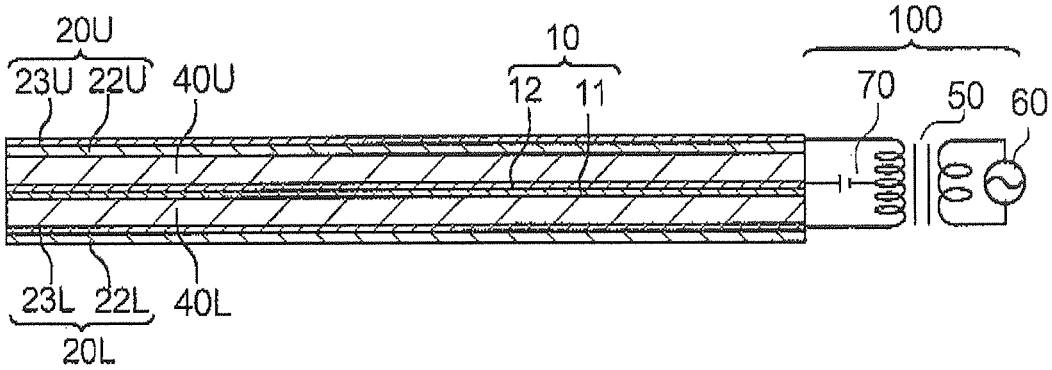
FIG. 5 is a cross-sectional view of the electrostatic speaker coupled with electronic components, showing an electronic configuration of the electrostatic speaker.

Next, an electronic configuration of the electrostatic speaker 1 will be described with reference to FIG. 5. As shown in FIG. 5, the electrostatic speaker 1 is coupled with a transformer 50, an input unit 60 for inputting audio signals from an external device (not shown), and a drive unit 100 having a bias power source 70 for applying a DC bias voltage to the diaphragm 10.

The bias power source 70 is connected to the conductive layer 12 of the diaphragm 10 and a neutral point of the output side of the transformer 50. An upper terminal of the output side of the transformer 50 is connected to the conductive layer 23U of the electrode 20U, while a lower terminal of the output side of the transformer 50 is connected to the conductive layer 23L of the electrode 20L. The input side of the transformer 50 is connected with the input unit 60. In this configuration, when the input unit 60 receives an audio signal, the transformer 50 produces a voltage based on the audio signal, so that the voltage is applied to the conductive layers 23U and 23L of the electrodes 20U and 20L; hence, the electrostatic speaker 1 functions as a push-pull electrostatic speaker.

Figure 6A:
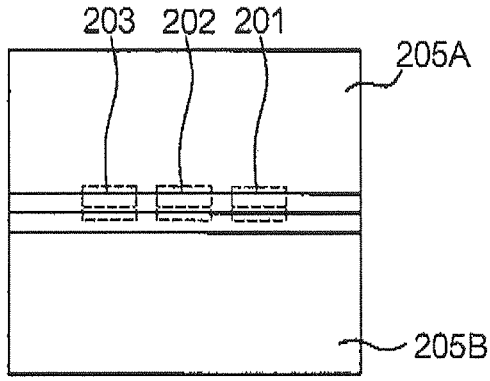
FIG. 6A is a front view of a clip which holds the electrostatic speaker.
Figure 6B:
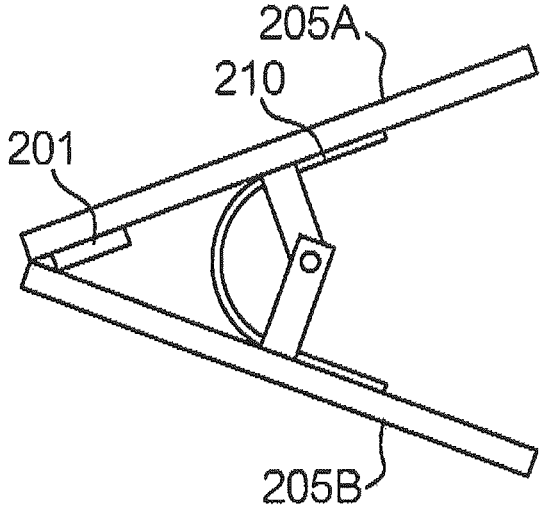
FIG. 6B is a side view of the clip including plastic plates and electrodes.

The electrostatic speaker 1 is connected to the drive unit 100 via a clip 200. FIG. 6A is a front view of the clip 200, and FIG. 6B is a side view of the clip 200. The clip 200 includes rectangular electrodes 201 through 203 and a spring 210. The clip 200 further includes plastic plates 205A and 205B which are assembled together and positioned opposite to each other. The electrodes 201 through 203 are fixed to the plastic plate 205A.

The electrode 201 is connected with a conducting wire (not shown) which is connected to one terminal of the output side of the transformer 50 whilst the electrode 203 is connected with a conducting wire (not shown) which is connected to another terminal of the output side of the transformer 50. The electrode 202 is connected with a conducting wire (not shown) which is connected to the bias power source 70.

Figure 7:
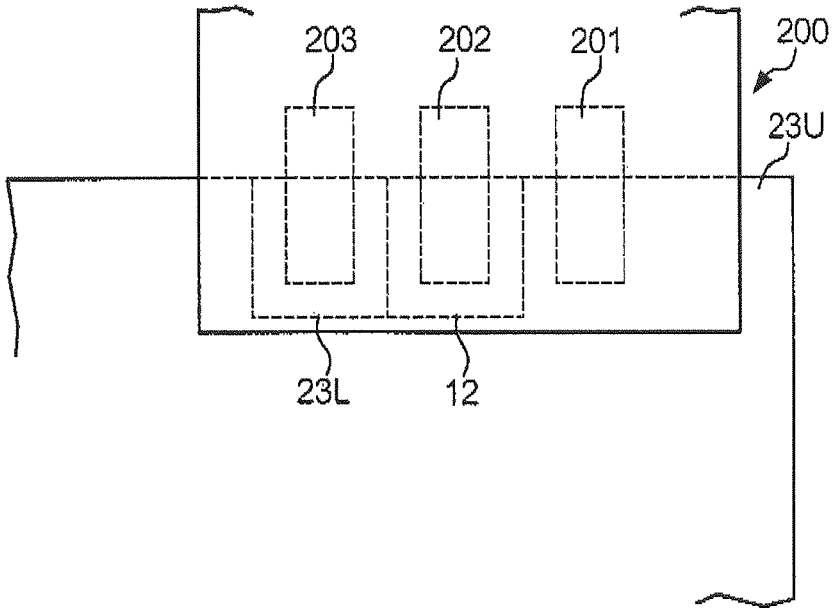
FIG. 7 is a plan view partly in section, showing the clip holding the electrostatic speaker with electrodes.

The clip 200 tightly holds the electrostatic speaker 1 at the cutouts as shown in FIG. 7, the electrode 201 comes in contact with the conductive layer 23U. Since the conductive layer 12 of the diaphragm 10 and the conductive layer 23L of the electrode 20L are exposed through the cutouts, the electrode 202 comes in contact with the conductive layer 12 whilst the electrode 203 comes in contact with the conductive layer 23L.

Next, the operation of the electrostatic speaker 1 will be described in detail. When the input unit 60 receives an audio signal, the transformer 50 correspondingly produces a voltage (corresponding to the audio signal), which is applied to the conductive layers 23U and 23L of the electrodes 20U and 20L via the electrodes 201 and 203 of the clip 200. When a potential difference occurs between the conductive layers 23U and 23L, an electrostatic force is induced so that the diaphragm 10 is attracted toward either the electrode 20U or the electrode 20L.

When the transformer 50 applies a positive voltage to the conductive layer 23U while applying a negative voltage to the conductive layer 23L in response to an audio signal input to the input unit 60, the diaphragm 10, whose conductive layer is already applied with a "positive" bias voltage from the bias power source 70, is repelled by the "positively charged" conductive layer 23U while being attracted toward the "negatively charged" conductive layer 23L; hence, the diaphragm 10 is displaced toward the electrode 20L.

In contrast, when the transformer applies a negative voltage to the conductive layer 23U while applying a positive voltage to the conductive layer 23L in response to an audio signal input to the input unit 60, the diaphragm 10 is attracted toward the "negatively charged" conductive layer 23U while being repelled by the "positively charged" conductive layer 23L; hence, the diaphragm 10 is displaced toward the electrode 20U.

As described above, the diaphragm 10 is displaced (or bent) toward either the electrode 20U or the electrode 20L in response to audio signals, wherein the displacement direction is alternately changed to cause vibration. Thus, the diaphragm 10 produces sound based on vibration conditions (e.g. frequency, amplitude, and phase). Sound permeates through the cushion material 40 and the electrodes 20U, 20L, so that the electrostatic speaker 1 emits sound in the external space.

The present embodiment is advantageous in that the electrostatic speaker 1 can be easily connected with the drive unit 100 by use of the clip 200 simply holding the electrostatic speaker 1, thus easily transmitting signals from the drive unit 100 to the conductive layers 12, 23U, and 23L. The present embodiment allows users to easily disconnect the drive unit 100 from the electrostatic speaker 1 by simply detaching the clip 200 from the electrostatic speaker 1. This realizes portability of the electrostatic speaker 1. The electrostatic speaker 1 of the present embodiment does not need conductive wires; hence, when the electrostatic speaker 1 is not used, it can be folded without problem and kept in a safe place.

The present embodiment can be modified in various ways; hence, it is possible to create the following variations, which can be combined as necessary.

(1) First Variation

A thin plate composed of a synthetic resin can be attached to a clipped region of the electrostatic speaker 1 being tightly held by the clip 200, thus reinforcing the cutouts. Alternatively, a conductive tape can be attached to a contact region of the electrostatic speaker 1 which is brought into contact with the electrodes 201 through 203, thus reinforcing the contact region of the electrostatic speaker 1.

(2) Second Variation

Figure 8:
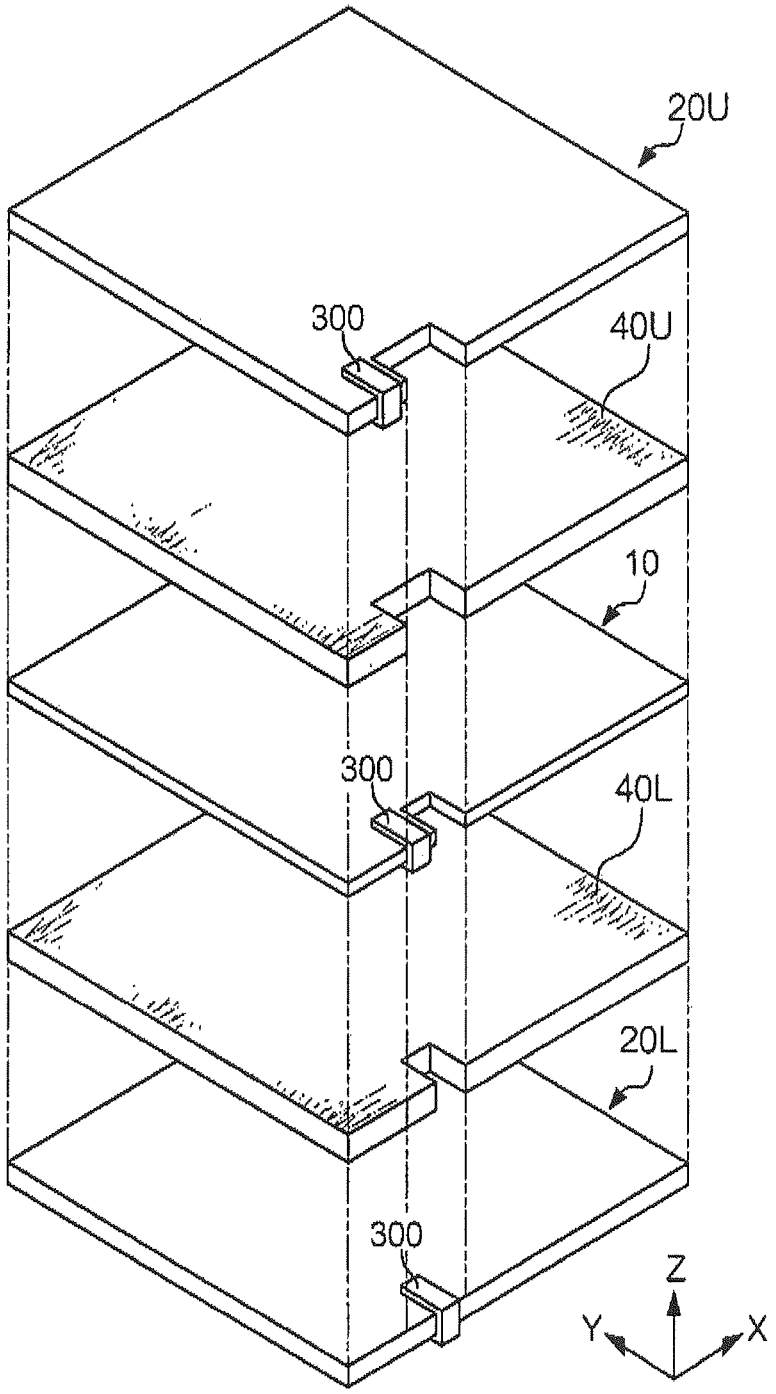
FIG. 8 is an exploded perspective view showing a second variation of the electrostatic speaker equipped with conductive clips holding conductive layers.

As shown in FIG. 8, it is possible to introduce conductive clips 300 in proximity to the cutout of the diaphragm 10 and the cutouts of the electrodes 20U and 20L, thus reinforcing the contact region of the electrostatic speaker 1, which comes in contact with the electrodes 201 through 203.

Figure 9:
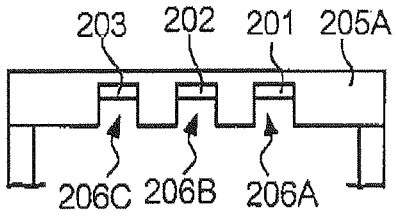
FIG. 9 is a front view showing a modification of the clip adapted to the conductive clips incorporated into the electrostatic speaker.

In addition, the clip 200 can be modified as shown in FIG. 9 in connection with the clip 300 adapted to the electrostatic speaker 1. FIG. 9 is a front view of the plastic plate 205A of the clip 200 which is modified in connection with the clip 300. The plastic plate 205A has recesses 206A through 206C whose depths are larger than the thicknesses of the electrodes 201 through 203. That is, the electrodes 201 through 203 are disposed inside the recesses 206A through 206C of the plastic plate 205A. When the clip 200 holds the electrostatic speaker 1 equipped with the clips 300, the clip 300 holding the conductive layer 23U enters into the recess 206A in contact with the electrode 201; the clip 300 holding the conductive layer 12 enters into the recess 206B in contact with the electrode 202; and the clip 300 holding the conductive layer 23L enters into the recess 206C in contact with the electrode 203. Since the clips 300 are engaged with the recesses 206A through 206C, the clips 300 are hardly dislocated from the electrostatic speaker 1.

(3) Third Variation

In the present embodiment, the conductive layers 12, 23U and 23L are partially exposed in plan view and positioned adjacently; but the exposed portions of the conductive layers 12, 23U and 23L do not need to be positioned adjacently.

Figure 10:
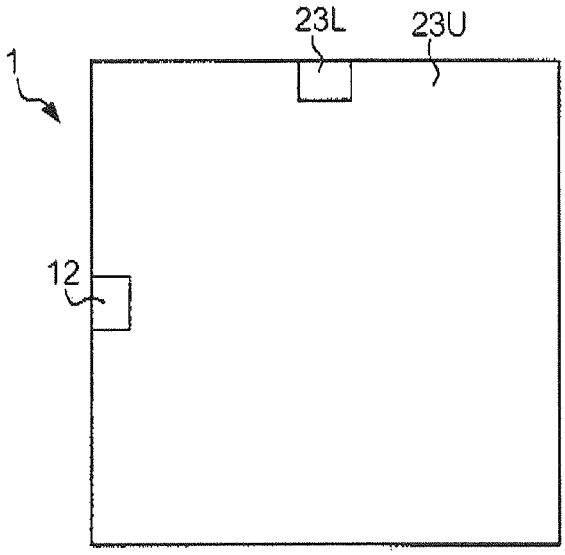
FIG. 10 is a plan view showing a third variation of the electrostatic speaker.

FIG. 10 is a plan view of the electrostatic speaker 1 according to a third variation, in which the exposed portion of the conductive layer 12 is separated from the exposed portion of the conductive layer 23L. In this connection, the clip 200 needs to be divided into three pieces, i.e. a first clip having the electrode 201 disposed in contact with the conductive layer 23U, a second clip having the electrode 202 disposed in contact with the conductive layer 12, and a third clip having the electrode 203 disposed in contact with the conductive layer 23L.

(4) Fourth Variation

In the first embodiment, the electrostatic speaker 1 is connected with the drive unit 100 via the clip 200 having the electrodes 201 through 203; but this is not a restriction.

Figure 11:
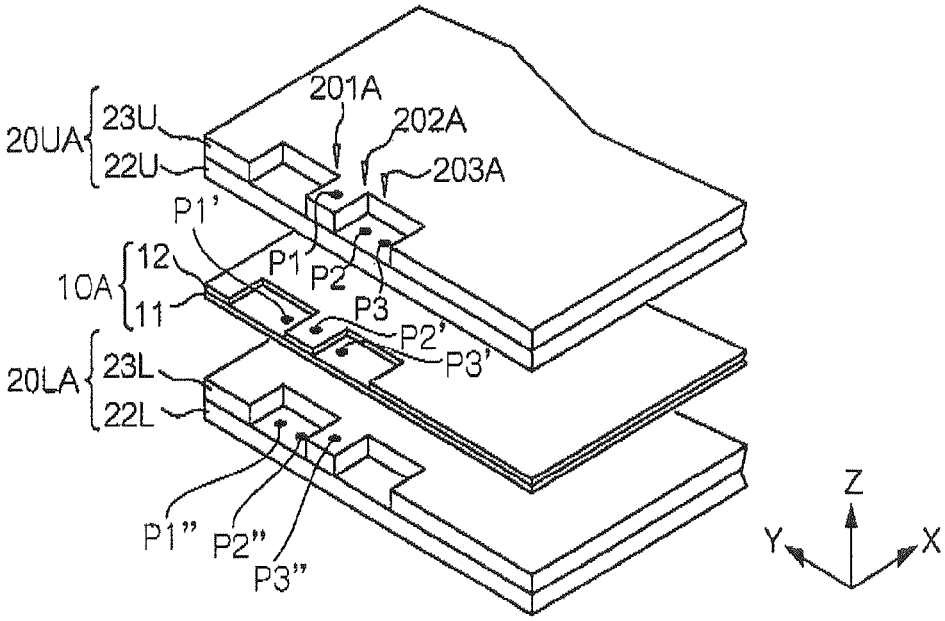
FIG. 11 is an exploded perspective view showing a fourth variation of the electrostatic speaker.

FIG. 11 is an exploded perspective view showing a fourth variation of the electrostatic speaker 1 constituted of an electrode 20UA, a diaphragm 10A, and an electrode 20LA, in which the cushion materials 40U and 40L are not illustrated. The electrode 20UA has two cutouts which are formed along the width direction in the conductive layer 23U. Similarly, the diaphragm 10A has two cutouts which are formed along the width direction in the conductive layer 12. The electrode 20LA has two cutouts which are formed along the width direction in the conductive layer 23L. All the cutouts have the same width (along the width direction) and the same length (along the length direction) although they are formed at different positions. In addition, the cutouts are formed in only the conductive layers 12, 23U and 23L, whilst no cutouts are formed in the films 11, 22U and 22L.

Specifically, two cutouts of the conductive layer 23U are horizontally disposed and isolated with half the width of cutout therebetween. The two cutouts of the conductive layer 12 are horizontally disposed and isolated with a half the width of each cutout. In addition, two cutouts of the conductive layer 12 are positionally shifted half the width of cutout rightwards from the two cutouts of the conductive layer 23U. Furthermore, two cutouts of the conductive layer 23L are positionally shifted half the width of cutout rightwards from the two cutouts of the conductive layer 12.

In this connection, the clip 200 needs to be adapted to the electrostatic speaker 1 including the diaphragm 10A, the electrodes 20UA and 20LA shown in FIG. 11 by way of electrodes 201A to 203A having needle shapes. When the clip 200 holds the electrostatic speaker 1, the electrode 201A is put into a point P1; the electrode 202A pierces into a point P2; and the electrode 203A is put into a point P3.

Specifically, the electrode 201A runs through points P1, P1', and P1", wherein the point P1 has the conductive layer 23U whilst the points P1' and P1" do not have the conductive layers 12 and 23L due to the cutouts; hence, the electrode 201A comes in contact with the conductive layer 23U but does not come in contact with the conductive layers 12 and 23L. That is, a voltage of the electrode 201 A is selectively applied to the conductive layer 23U.

In addition, the electrode 202A runs through points P2, P2' and P2", wherein the point P2 does not have the conductive layer 23U due to the cutout, the point P2' has the conductive layer 12, and the point P2" does not have the conductive layer 23L due to the cutout; hence, the electrode 202A comes in contact with the conductive layer 12 but does not come in contact with the conductive layers 23U and 23L. That is, a voltage of the electrode 202A is selectively applied to the conductive layer 12.

Furthermore, the electrode 203A pierces through points P3, P3', and P3", wherein the point P3 does not have the conductive layer 23U due to the cutout, the point P3' does not have the conductive layer 12 due to the cutout, and the point P3" has the conductive layer 23L; hence, the electrode 203A does not come in contact with the conductive layers 23U and 12 but comes in contact with the conductive layer 23L. That is, a voltage of the electrode 203A is selectively applied to the conductive layer 23L.

As described above, the fourth variation is able to transmit signals of the drive unit 100 to the electrostatic speaker 1 by using the clip 200 simply holding the electrostatic speaker 1.

(5) Fifth Variation

Figure 12:
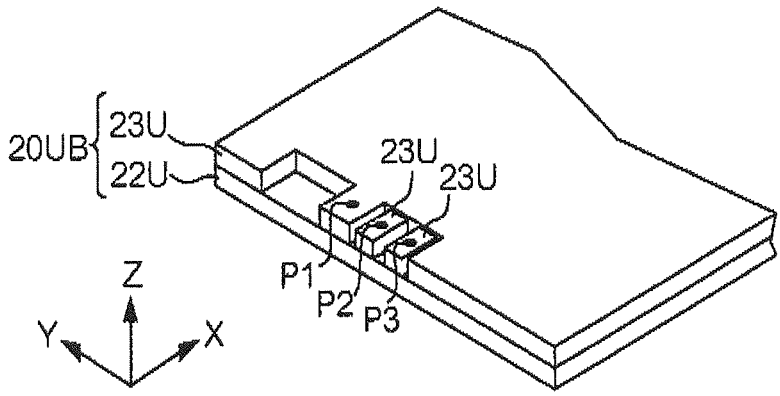
FIG. 12 is a perspective view showing a fifth variation of the electrostatic speaker.

The electrostatic speaker 1 according the above embodiment and variations are characterized by forming cutouts in conductive layers; but this is not a restriction. FIG. 12 is a perspective view showing a fifth variation of the electrostatic speaker 1, in particular focusing on an electrode 20UB. Compared with the electrode 20UA shown in FIG. 11, the electrode 20UB has a single cutout and two islands disposed in connection with the points P2 and P3, wherein two islands are isolated parts of the conductive layer 23U whose surrounding areas (having predetermined widths) are cut out. Even when the electrodes 202A and 203A run through the points P2 and P3, voltages of the electrodes 202A and 203A are not applied to the point P1, which is applied with a voltage of the electrode 201A, because the conductive layer 23U is removed in cutting margins surrounding the points P2 and P3. Similar to the electrode 20UB, the diaphragm 10 and the electrode 20L can be modified such that the conductive layers 12 and 23L are removed in cutting margins surrounding selected points.

(6) Sixth Variation

Figure 13:
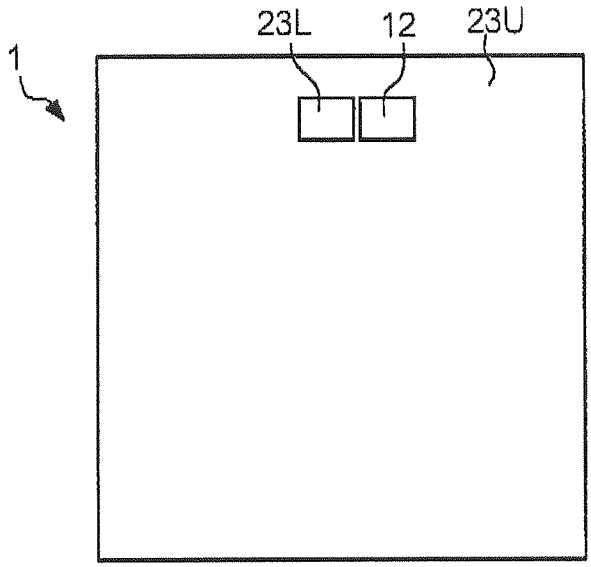
FIG. 13 is a plan view showing a sixth variation of the electrostatic speaker.

In the present embodiment, the conductive layer 12 of the diaphragm 10 and the conductive layer 23L of the electrode 20L are exposed along an edge of the electrostatic speaker 1; but this is not a restriction. FIG. 13 is a plan view showing a sixth variation of the electrostatic speaker 1, in particular focusing on the conductive layer 23U of the electrode 20U. As shown in FIG. 13, rectangular holes are formed to run through the electrode 20U, the diaphragm 10, and the cushion materials 40U and 40L, wherein the conductive layers 12 and 23L are exposed in the internal area inwardly of an edge of the electrostatic speaker 1.

In this connection, the electrodes 20U and 20L can be composed of conductive cloths or nonwoven fabrics having conductivity. Alternatively, the electrodes 20U and 20L can be composed of punching metals.

(7) Seventh Variation

Figure 14:
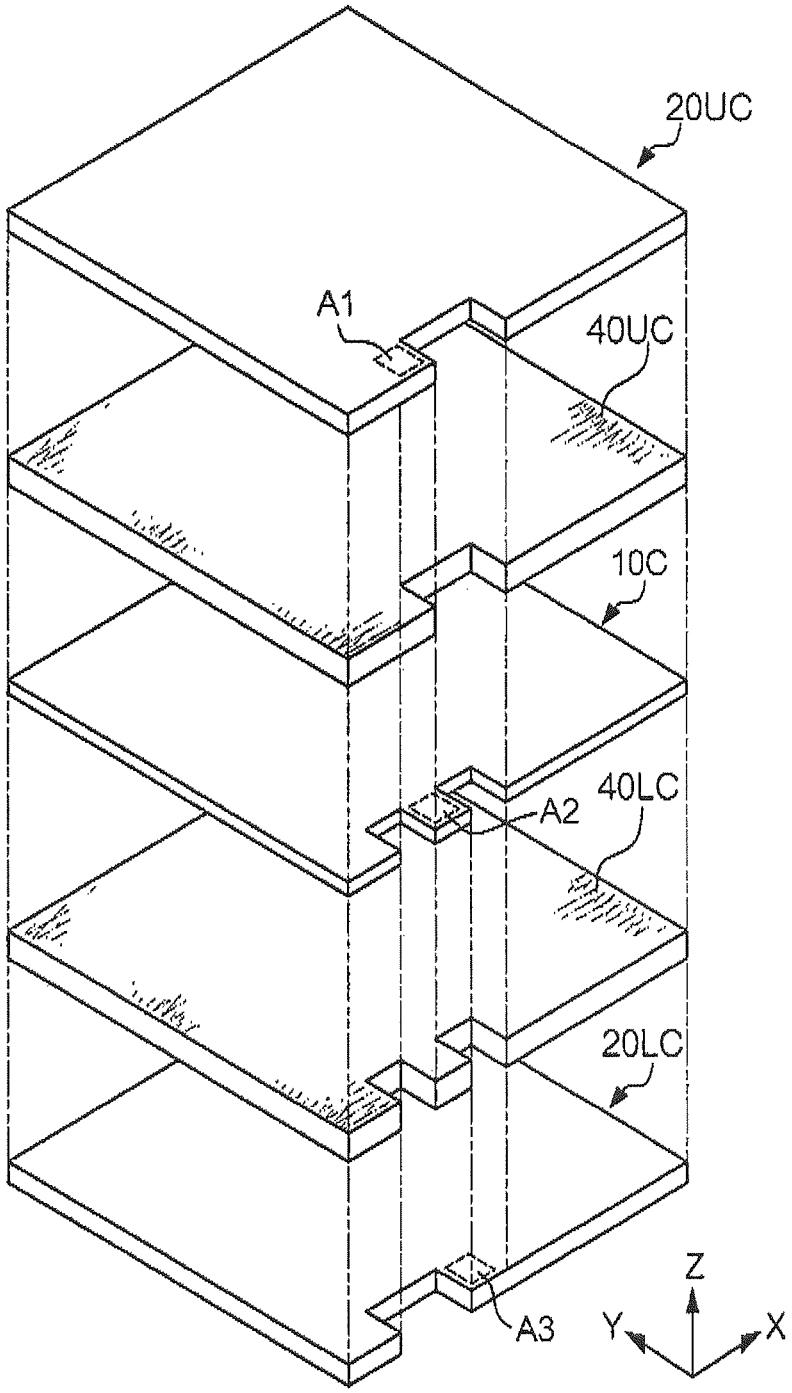
FIG. 14 is an exploded perspective view showing a seventh variation of the electrostatic speaker.

The cutouts formed in the constituent elements of the electrostatic speaker 1 are not necessarily formed in rectangular shapes shown in FIG. 3. It is possible to modify cutouts as shown in FIG. 14. FIG. 14 shows a seventh variation of the electrostatic speaker 1 constituted of electrodes 20UC, 20LC, a diaphragm 10C, and cushion materials 40UC, 40LC. Specifically, the electrode 20UC has a single cutout; the cushion material 40UC has a single cutout; the diaphragm 10C has two cutouts which are separated from each other; the cushion material 40LC has two cutouts which are separated from each other; and the electrode 20LC has a single cutout.

When the clip 200 holds the electrostatic speaker 1 of FIG. 14, the electrode 201 comes in contact with a region Al proximate to a cutout on the conductive layer of the electrode 20UC; the electrode 202 comes in contact with a region A2 disposed between two cutouts on the conductive layer of the diaphragm 10C; and the electrode 203 comes in contact with a region A3 proximate to a cutout on the conductive layer of the electrode 20LC. Due to the cutouts of the diaphragm 10C and the electrode 20LC just below the region A1 of the electrode 20UC, the electrode 201 of the clip 200 selectively comes in contact with the conductive layer of the electrode 20UC. Due to the cutouts of the electrodes 20UC and 20LC just above and below the region A2 of the diaphragm 10C, the electrode 202 of the clip 200 selectively comes in contact with the conductive layer of the diaphragm 10C. Due to the cutouts of the electrode 20UC and the diaphragm 10C just above the region A3 of the electrode 20LC, the electrode 203 of the clip 200 selectively comes in contact with the conductive layer of the electrode 20LC.

(8) Eighth Variation

Figure 15:
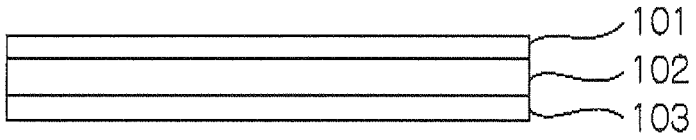
FIG. 15 is a side view showing a basic configuration of an electrostatic speaker according to the present invention.

The present invention has a basic configuration of an electrostatic speaker including a first conductive film 101, a first insulating layer 102, and a second conductive film 103 which are sequentially laminated in a vertical direction as shown in FIG. 15. One of the first conductive film 101 and the second conductive film 103 serves as a diaphragm whilst the other serves as an electrode.

Figure 16:
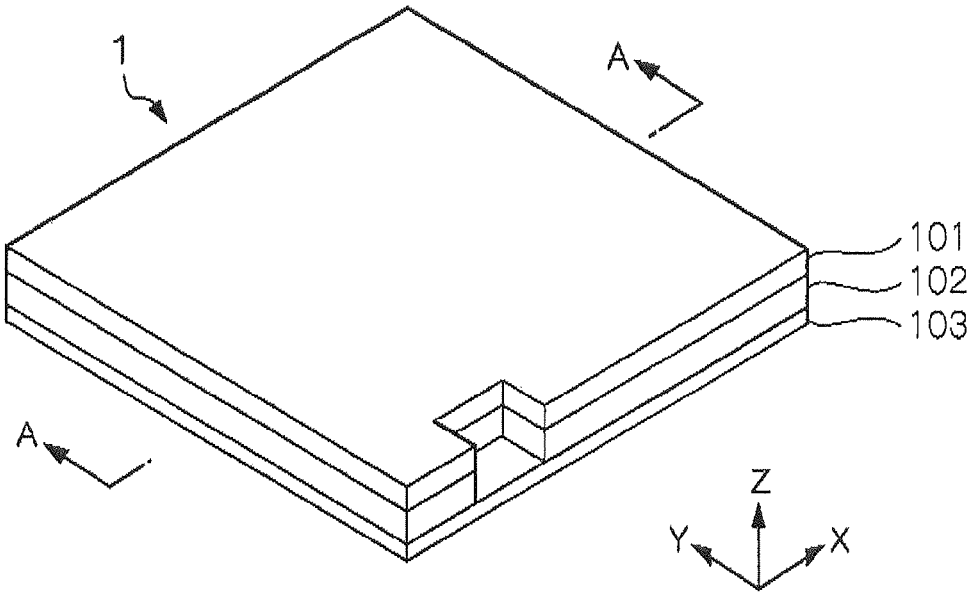
FIG. 16 is a perspective view showing an eighth variation of the electrostatic speaker having the basic configuration.

FIG. 16 shows that a hole or cutout for supplying power to the second conductive film 103 is formed in the first conductive film 101 and the first insulating 102 so as to partially expose the second conductive film 103.

When a clip having an electrode (not shown) holds the electrostatic speaker of FIG. 16 at the hole or cutout the electrode of the clip comes in contact with the second conductive film 103, thus supplying power to the second conductive film 103.

Figure 17:
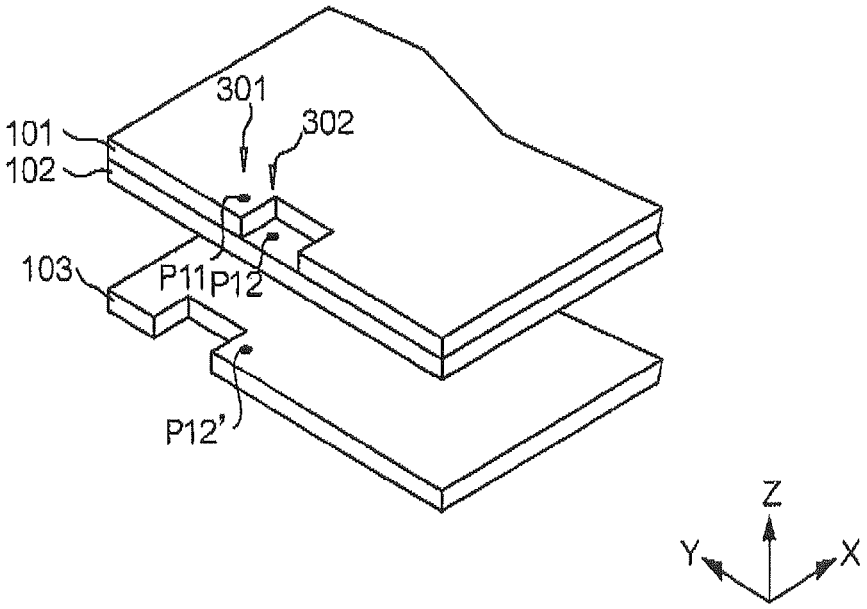
FIG. 17 is an exploded perspective view showing a further modification of the electrostatic speaker having the basic configuration.

FIG. 17 shows that holes or cutout are formed in the first conductive film 101 and the second conductive film 103, thus supplying power to the second conductive film 103. In this connection, a hole or cutout of the first conductive film 101 is positionally shifted from a hole or cutout of the second conductive film 103 in the width direction in plan view.

When a clip having electrodes 301 and 302 (not shown) holds the electrostatic speaker of FIG. 17, the electrode 301 pricks on a point P11 whilst the electrode 302 pierces between points P12 and P12'. The electrode 301 comes in contact with the first conductive film 101 but does not come in contact with the second conductive film 103 due to its hole or cutout, thus selectively supplying power to the first conductive film 101. In addition, the electrode 302 does not come in contact with the first conductive film 101 due to its hole or cutout but comes in contact with the second conductive film 103, thus selectively supplying power to the second conductive film 103.

Lastly, the present invention is not necessarily limited to the above embodiment and variations, which can be further modified within the scope of the invention as defined in the appended claims.

What is claimed is:

1. An electrostatic speaker comprising:

a first electrode having conductivity;

a second electrode having conductivity and being disposed opposite to and distanced from the first electrode;

a diaphragm having conductivity and being interposed between the first electrode and the second electrode, and distanced from the first electrode and the second electrode;

a first elastic member interposed between the first electrode and the diaphragm; and a second elastic member interposed between the diaphragm and the second electrode, wherein the first electrode, the first elastic member, the diaphragm, and the second elastic member define a first window such that the second electrode is at least partially exposed in the first window, and wherein the first electrode and the first elastic member define a second window such that the diaphragm is at least partially exposed in the second window.

2. The electrostatic speaker according to claim 1, wherein an exposed part of the diaphragm horizontally adjoins an exposed part of the second electrode.

3. The electrostatic speaker according to claim 2, wherein the exposed part of the diaphragm and the exposed part of the second electrode horizontally adjoin along an edge line of the electrostatic speaker.

4. The electrostatic speaker according to claim 1, wherein both the first elastic member and the second elastic member have an electrical insulating property.

5. The electrostatic speaker according to claim 1, wherein the first window is adjacent to the second window.

6. The electrostatic speaker according to claim 1, wherein the portion of the first window defined by the first electrode and the first elastic member collectively defines a single window with the second window.

7. The electrostatic speaker according to claim 1, wherein the first window and the second window both extend to an edge line of the electrostatic speaker.

8. The electrostatic speaker according to claim 1, further comprising a clip electrically connected to a transformer and having three rectangular electrodes coupled to the first electrode, the diaphragm, and the second electrode, respectively.

9. The electrostatic speaker according to claim 1, further comprising:

a first conductive clip affixed to the first electrode;

a second conductive clip affixed to the diaphragm; and a third conductive clip affixed to the second electrode.

10. The electrostatic speaker according to claim 9, further comprising a clip electrically connected to a transformer and having three recesses with respective rectangular electrodes disposed therein, the rectangular electrodes being coupled to the first, second, and third conductive clips, respectively.

11. An electrostatic speaker comprising:

a first electrode;

a second electrode which is disposed opposite to and distanced from the first electrode;

a diaphragm interposed between the first electrode and the second electrode;

wherein the first electrode defines a first window such that the diaphragm is at least partially exposed in the first window, wherein the second electrode defines a second window such that the diaphragm is at least partially exposed in the second window, wherein the first electrode and the diaphragm define a third window such that the second electrode is at least partially exposed in the third window, and wherein the second electrode and the diaphragm define a fourth window such that the first electrode is at least partially exposed in the fourth window.

12. The electrostatic speaker according to claim 11, wherein the first electrode is constituted of a first base material and a first conductive layer which are laminated together, wherein the second electrode is constituted of a second base material and a second conductive layer which are laminated together, wherein the diaphragm is constituted of a third base material and a third conductive layer which are laminated together, and wherein the respective windows of the first electrode, the second electrode, and the diaphragm are formed in the first conductive layer, the second conductive layer, and the third conductive layer respectively.

13. The electrostatic speaker according to claim 11, further comprising:

a first elastic member interposed between the first electrode and the diaphragm; and a second elastic member interposed between the diaphragm and the second electrode.

14. An electrostatic speaker comprising:

a first electrode having conductivity;

a second electrode having conductivity and being disposed opposite to and distanced from the first electrode;

a diaphragm having conductivity and being interposed between the first electrode and the second electrode, and distanced from the first electrode and the second electrode;

a first elastic member interposed between the first electrode and the diaphragm;

a second elastic member interposed between the diaphragm and the second electrode; and an opening extending at least partially through the electrostatic speaker, the opening having a first portion that at least partially exposes the diaphragm and a second portion that at least partially exposes the second electrode.

15. The electrostatic speaker according to claim 14, wherein the first portion of the opening extends through the first electrode the first elastic member, and wherein the second portion of the opening extends through the first electrode, the first elastic member, the diaphragm, and the second elastic member.

16. The electrostatic speaker according to claim 14, wherein the opening extends to an edge line of the electrostatic speaker.

17. The electrostatic speaker according to claim 14, further comprising a clip electrically connected to a transformer and having three rectangular electrodes coupled to the first electrode, the diaphragm, and the second electrode, respectively.

18. The electrostatic speaker according to claim 14, further comprising:

a first conductive clip affixed to the first electrode;

a second conductive clip affixed to the diaphragm; and a third conductive clip affixed to the second electrode.

19. The electrostatic speaker according to claim 18, further comprising a clip electrically connected to a transformer and having three recesses with respective rectangular electrodes disposed therein, the rectangular electrodes being coupled to the first, second, and third conductive clips, respectively.

* * * * *